US006339864B1

(12) United States Patent
Albrecht et al.

(10) Patent No.: US 6,339,864 B1
(45) Date of Patent: Jan. 22, 2002

(54) MOUNTING PLATE FOR CABINET HINGES

(75) Inventors: Markus Albrecht; Wolfgang Muller, both of Lustenau (AT)

(73) Assignee: Grass GmbH, Voralberg (AT)

( * ) Notice: Subject to any disclaimer, the term of this patent is extended or adjusted under 35 U.S.C. 154(b) by 0 days.

(21) Appl. No.: 09/562,691

(22) Filed: May 2, 2000

(30) Foreign Application Priority Data

May 3, 1999 (DE) ..... 199 20 137

(51) Int. Cl.[7] ..... E05D 7/10
(52) U.S. Cl. ..... 16/258; 16/246; 16/382
(58) Field of Search ..... 16/258, 257, 382, 16/240–246, 248

(56) References Cited

U.S. PATENT DOCUMENTS 4,847,948 A * 7/1989 Gross et al. ..... 16/251
4,976,006 A * 12/1990 Lautenschlager ..... 16/238
5,022,116 A * 6/1991 Salice ..... 16/258
5,025,530 A * 6/1991 Ferrari et al. ..... 16/236
5,056,189 A * 10/1991 Brustle et al. ..... 16/235
5,062,180 A * 11/1991 Lautenschlager, Jr. ..... 16/257
5,210,907 A * 5/1993 Toyama ..... 16/258
5,245,727 A * 9/1993 Sasaki ..... 16/258

* cited by examiner

*Primary Examiner*—Chuck Y. Mah
(74) *Attorney, Agent, or Firm*—Kilpatrick Stockton LLP

(57) ABSTRACT

The invention consists of a mounting plate for cabinet hinges, a baseplate fastened on the cabinet body and an adjusting plate that can be fastened to the cabinet hinge's baseplate, so that a secure fastening of the catch connection results. In order to attain a stabile connection, and at the same time, an easy assembly, the invention has a baseplate that is designed in two parts; a bottom part that can be connected to the cabinet body and an upper part that can be "braced with" the bottom part, so that the adjusting plate and the upper part, by means of pressure on the adjusting plate resulting from a certain method of a forced sliding motion of the adjusting plate relative to the baseplate, are connected together by at least three linked means, and the connection made by a spring element on the adjusting plate secures against further movement.

14 Claims, 3 Drawing Sheets

MOUNTING PLATE FOR CABINET HINGES

Figure 1:
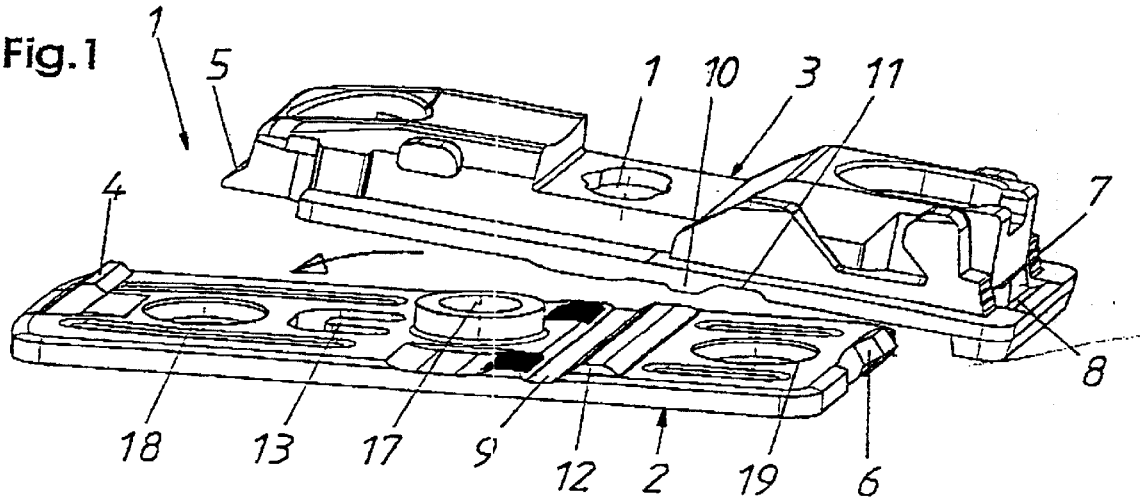

The invention is a mounting plate for cabinet hinges according to the characterizing clause of patent claim 1.

A mounting plate of this type is made known by DE 197 07 741 A1. It is a cabinet hinge consisting of a hinge arm or hinge joint fastened on a hinge cup, so that the hinge arm is adjustable by means of an adjusting plate that is connected to a baseplate on the cabinet body and has a catch fastener to fix the connection. The adjusting plate is designed as a one-piece, partially resilient catch component that, on the one side, can be engaged to the baseplate by means of hook-shaped shanks and, on the other side, has shanks that, when pressure is applied to the adjusting plate, moves the adjusting plate, engages in the corresponding catch noses of the baseplate, which secures the connection of the adjusting plate's resilient component against further movement. The above described known mounting plate has the disadvantage that the stability of the connection between the baseplate and the adjusting plate is not sufficient for many applications, and after the height adjustment screw is removed, the parts loosen and separate from one another.

Another disadvantage is that the adjusting plate has a front and back movement during installation, but the distances of the installation points and the attainable play compensation are not sufficient.

The present invention's task is a mounting plate for cabinet hinges that takes the above disadvantages into consideration, and is designed to attain a more stabile connection between the individual parts of the mounting plate, resulting in an easier and quicker installation.

The tasks are solved, shown by the technical features of the Patent claim 1.

The invention has a baseplate that is designed as two parts: a fastenable bottom part on the cabinet body and a braceable upper part, so that the adjusting plate and the upper part are connected when pressure is applied to the adjusting plate, resulting in forced sliding motion in relation to the adjusting plate's baseplate in at least three linking points. This connection secures the spring element on the adjusting plate against additional sliding.

Because both baseplate parts are braced, on the one hand, and the adjustment plate is triple engaged on the baseplate's upper part, on the other hand; all in all, an extremely strong, clearance-free connection between the baseplate and adjusting plate is obtained, which is secured by the spring element.

In a preferred embodiment, the bottom part forms a jog on the front end and a peg on the back end, which fits against the upper part's corresponding angles. This secures both parts against lifting in the vertical or perpendicular direction.

Furthermore, the bottom part, as well as the upper part, has, preferably, at least one guiding groove that works together with a corresponding guiding ridge of the upper part (as well as the bottom part), and fixes the bottom part and upper parts together. This tightens the bottom part and the upper part in a form-fitting manner, so that both end connections are clearance-free.

Additionally, the connection between the lower part and upper part are, preferably, secured with a locking screw, and the locking screw, in a preferred embodiment, simultaneously serves as a height-adjustment screw.

In order to prevent the release of the upper part from the lower part when the locking screw is loosened, the bottom part has a safety operational device in the form of a tab, which is located on the respective surface of the upper part, that prevents an unintentional "falling-out". Thus, both baseplate components cannot move lengthwise in relation to each other and cannot release from one another.

The preferred embodiment for fixing the adjusting plate to the upper part of the baseplate has side indentations on the front end of the upper part, which engage in the corresponding insertion ridges of the adjusting plate.

Futhermore, towards the middle of the upper part, there are side projections that engage in the respective insertion shanks of the adjusting plate. Side insertion shanks, located on the back end of the upper part, engage in the corresponding insertion shanks of the adjusting plate. The adjusting plate is inserted three-fold or six-fold in the upper part of the baseplate, resulting in a very secure connection and load transmission between these parts.

To make the insertion of the adjusting plate on the upper part easier, side stops are located on the front end of the adjusting plate, which work by means of the formed shoulder on the upper part and, together with other parts, result in a type of restricted guidance of the adjusting plate with the insertion process.

A spring element is provided to secure the connection between the adjusting plate and the baseplate. Preferably, the spring element is formed as one-piece from the adjusting plate, so that this spring clip, as a resilient, springy, frame-type border of the adjusting plate, projects to the back.

With the basic insertion and engagement process between the adjusting plate and the upper part, the insertion ridges and indentations, and the projections and the insertion shanks, engage with each other by sliding in the arrow direction (insertion direction) so that further sliding motions are halted by the stop located on the shoulder until pressure on the back end of the adjusting plate disengages the stop from the shoulder and allows an engagement of the insertion shank in the insertion shank, so that the spring clip glides over the catch steps on the upper part, activating a catch between the adjusting plate and upper part. These catch steps cause a compensation for play with the insertion components, resulting in the maximum play with the largest of the catch steps. It is essential that the forced sliding motion between the adjusting plate and the upper part is achieved by the insertion shank, which slides down on the corresponding gliding surfaces of the upper part.

The connection is unlatched by putting finger pressure on the spring clip in an upward lifting direction.

All records, documents and evidence, inclusive of the abstract, open and disclosed statements and declarations and indications and features, especially those represented embodiments in the drawings, will be claimed as fundamental and significant to the invention as far as the claims individually or in combinations, are relative to the position that the technology is new.

The invention at hand will be explained more precisely by the various embodiments shown by the representational drawings. Hereby, additional significant features and advantages of the invention will be concluded from the drawings and their descriptions.

Figure 2:
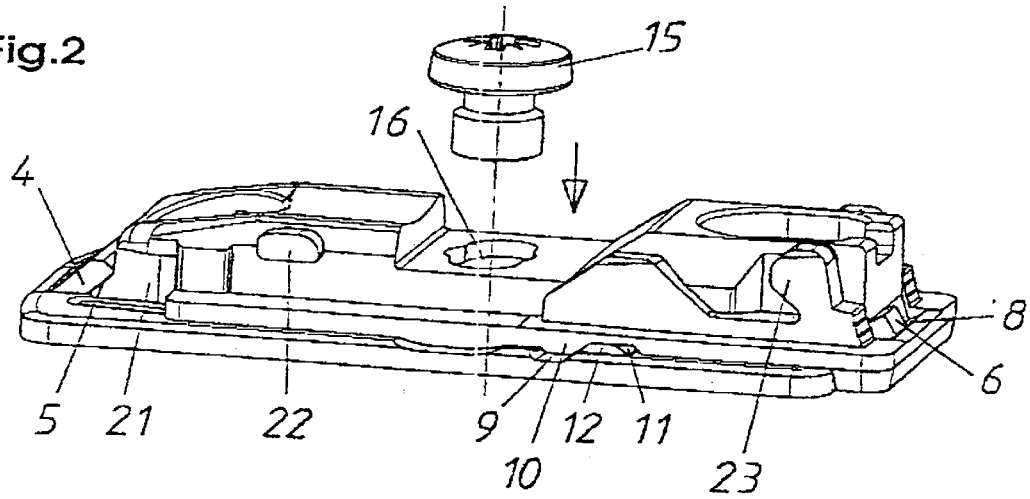
Figure 3:
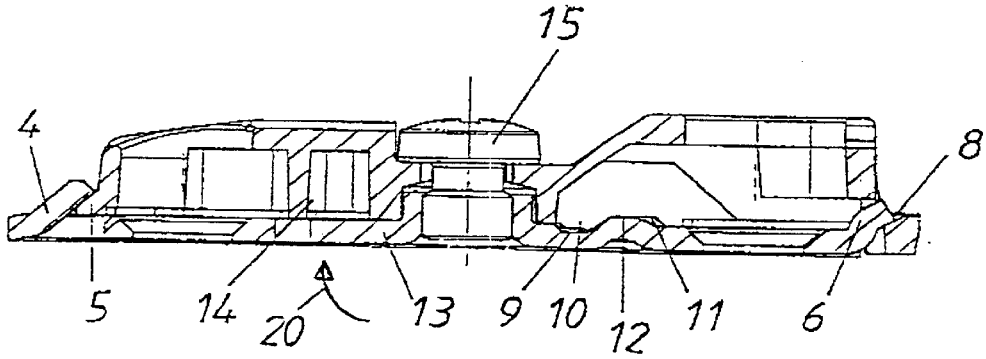
Figure 4:
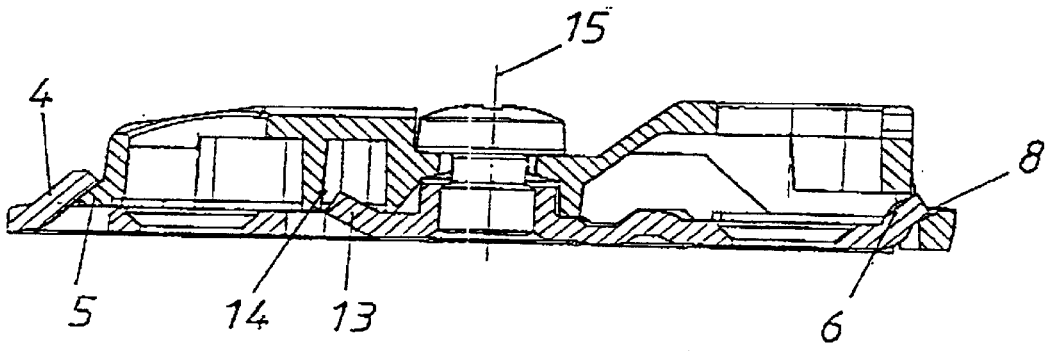
Figure 5:
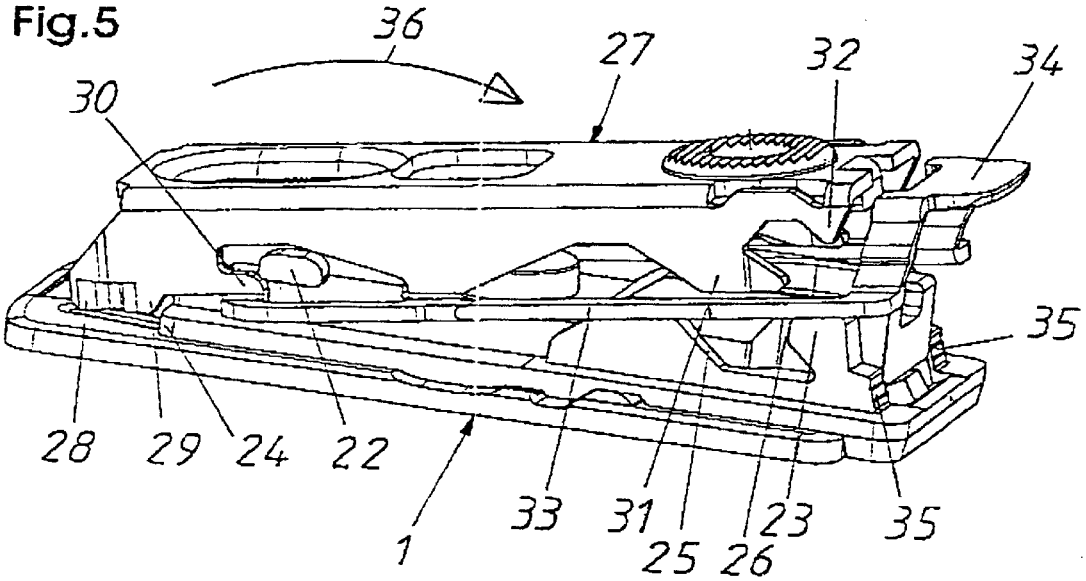
Figure 6:
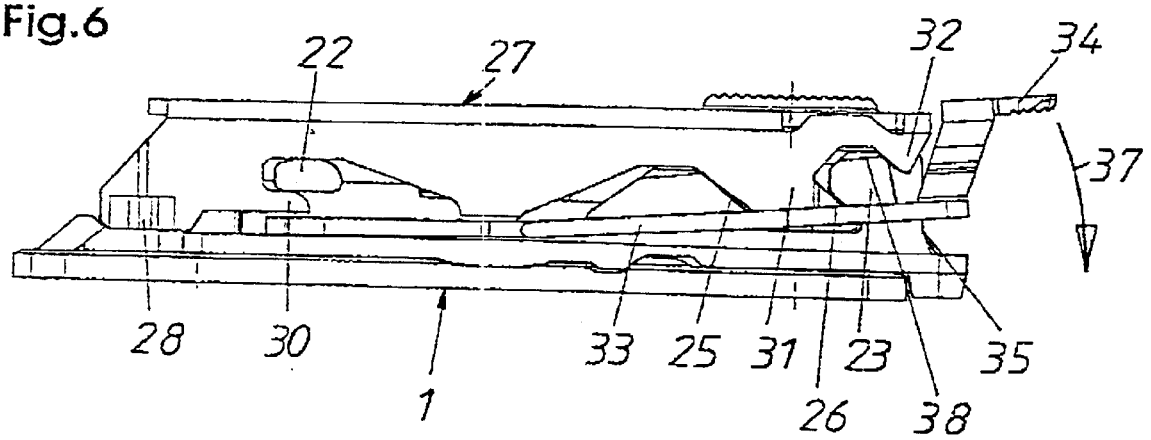
Figure 7:
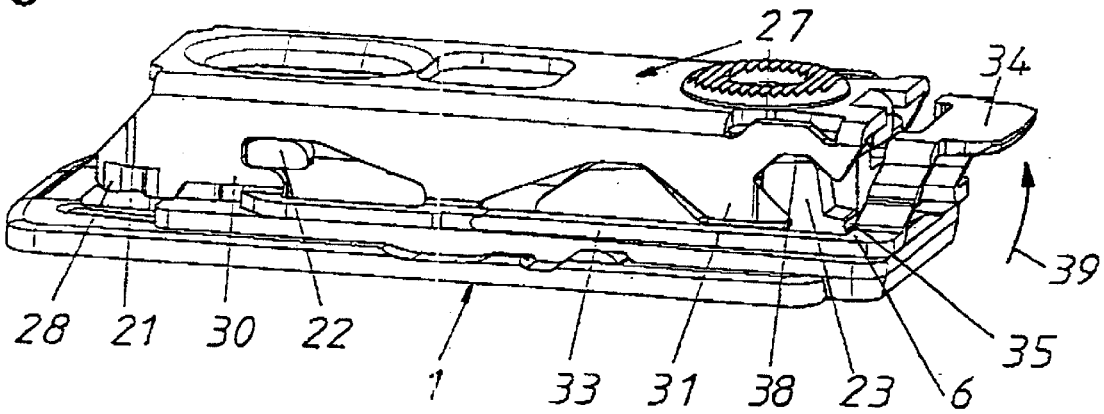
Figure 8:
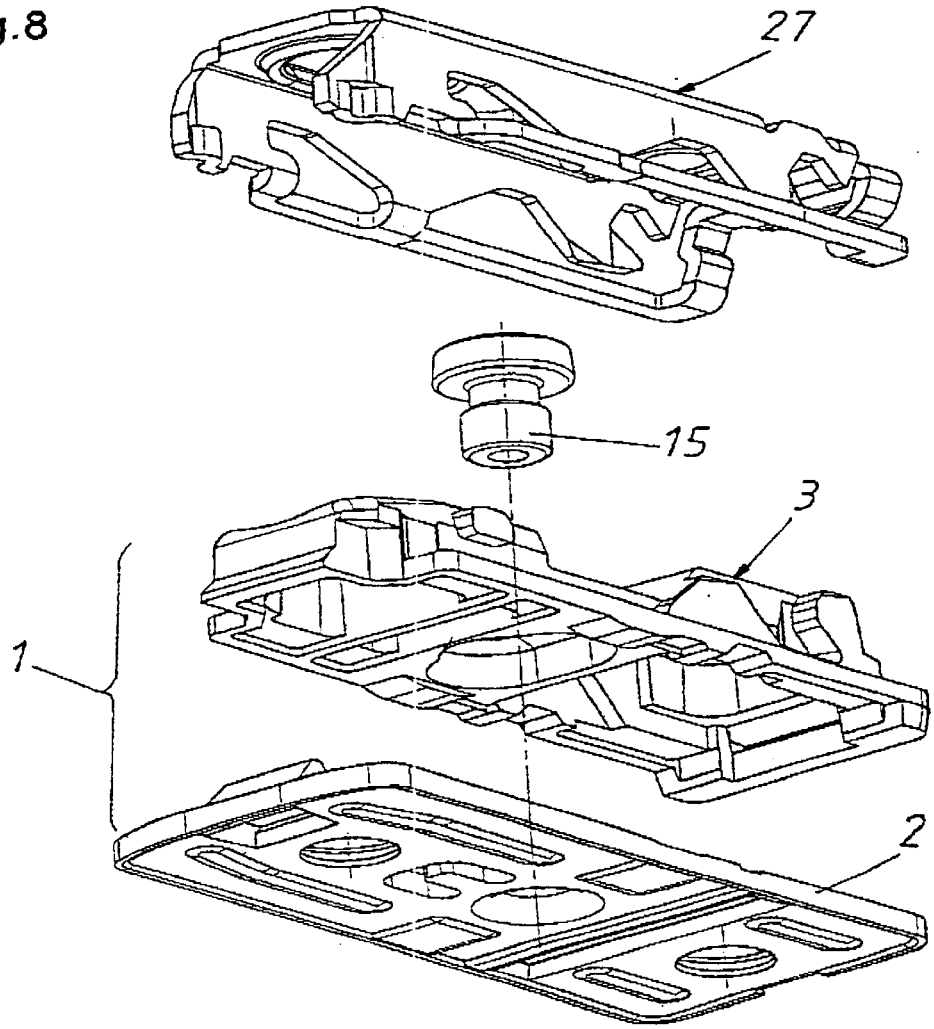

Shown:

FIG. 1: a perspective view of the baseplate, consisting of a bottom part and an upper part before assembly;

FIG. 2: a perspective view of the assembled baseplate;

FIG. 3: a longitudinal section through the assembled baseplate with an inserted locking screw;

FIG. 4: a longitudinal section through the assembled baseplate with an activated safety device, which prevents unintentional release;

FIG. 5: a perspective view of the baseplate when placed on the adjusting plate;

FIG. 6: a side view of the baseplate by an adjusting plate, almost completely in place;

FIG. 7: a perspective view of the baseplate with a completely placed adjusting plate;

FIG. 8: an enlarged representation of the individual components of the mounting plate.

FIG. 1 shows the construction of the baseplate (1), which consists of a bottom part (2) that is connected to an upper part (3). The bottom part (2) has on its front end a somewhat 45° upwardly angled jog (4) and on its back end a corresponding somewhat 45° protruding peg (6). The jog (4) and the peg (6) have corresponding respective angles (5,8) on the upper part (3); the upper part (3) inserts in the bottom part (2) so that the jog (4) and the peg (6) fit on the corresponding angles (5,8). Then the peg (6) grips through an opening (7) of the upper part (3). At least one guiding groove (9) is on the bottom part (2) on which a corresponding guiding ridge (10) on the inserted upper part (3) engages and secures the position between the assembly components (2,3) in the longitudinal direction. In the presented example, an upper part (3) has an additional guiding groove (11), which works together with a respective guiding ridge (12) of the bottom part (2).

The bottom part, itself, is fastened to the cabinet body by means of screws or something similar, engaged in the corresponding boreholes (18,19).

Furthermore, there is on the bottom part a safety device (13), which prevents unintentional "falling-out" and takes the form of tab, which, after the upper part's (3) assembly on the bottom part (2), is pressed upward (see FIG. 4) and, thus, fits on a corresponding surface (14) of the upper part, so that shifting between the bottom part (2) and the upper part (3) is no longer possible. This safety device (13,14) against unintentional release holds the bottom part (2) and the upper part (3) together, even when the provided locking screw (15), which engages through an opening (16) of the upper part (3) into a corresponding thread (17) in the bottom part (2), is unscrewed. The locking screw (15) serves simultaneously as a height adjustment screw; that is, the upper part (3) can be moved in a lateral direction on the bottom part (2) and its position can be secured by the locking screw (15).

FIG. 2 shows the bottom part (2) with the placed upper part, as the locking screw (15) is just being inserted. FIG. 3 shows the safety device (13) that prevents unintentional release, which, after the upper part (3) is mounted on the bottom part (2) in arrow direction (20), bends upward so that the tabs (13) lie on the corresponding surface (14) of the upper part (see FIG. 4).

FIG. 2 shows other various insertion means for fastening the adjusting plate (27) on the baseplate (1), respectively, the upper part (3) of the baseplate (1). The upper part (3) has, for this purpose, side indentations (21) in the front area, which, as shown in conjunction with FIG. 5, are used for inserting with insertion projections (28). The insertion projections (28) are formed from the material of the adjusting plate (27).

The upper part (3) has, in the direction of its center in the upper area, additional side projections (22), which serve to insert with the corresponding insertion shanks (30) of the adjusting plate (27). Another means of insertion is provided on the back end of the upper part (3). This consists of side insertion shanks (23), which work together with the respective insertion shanks (31) of the adjusting plate (27).

FIG. 5 shows the insertion of the adjusting plate (27) on the baseplate (1). Then the front area of the adjusting plate (27) inserts in the upper part (3) of the baseplate (1). The insertion projections (28) of the adjusting plate (27) engage in the corresponding indentations (21) of the upper part and, simultaneously, the projections (22) in the upper part (3) engage with the insertion shanks (30) of the adjusting plate (27). Too strong an insertion movement (pre-movement) of the adjusting plate (27) is impeded by an additional stop (29) on the adjusting plate (27), which fits itself on a shoulder (24) that is formed by the upper part (3) of the baseplate (1). Only by additional pressure on the back area of the adjusting plate (27), the adjusting plate (27) goes back into the correct insertion angle so that the insertion shank (31) of the adjusting plate (27) glides down the corresponding sliding surfaces (25,26) of the upper part and engages with the insertion shanks (23) of the upper part, resulting in an insertion position that is represented in FIG. 6. Furthermore, one sees that the formed nose (32) on the back end of the adjusting plate (27) lies over the insertion shank (23) of the upper part.

The adjusting plate (27) consists of a basically u-shaped bent, longish, one-piece part, which is preferably made of metal. A spring clip (33) is formed one-piece from the adjusting plate (27), whose shank it grips in somewhat the center area of the long side of the adjusting plate and continues towards the back over the end of the adjusting plate, where they are connected by a lever (34) that is formed on the back end of the spring clip (33), so that the spring clip can be operated manually.

In FIG. 6, the spring clip (33) is not yet engaged in its final position on the upper part (3) of the baseplate. As shown in FIG. 5, the upper part (3) has on its back end, left and right, catch steps (35), which serve to catch the back section of the spring clip (33). These catch steps (33) provide clearance/play balance and guarantee a clearance-free or nearly clearance-free catch of the spring clip (33) on the upper part (3). The catch process proceeds in arrow direction (37) in FIG. 6.

FIG. 7 shows the finished mounting plate after the insertion and engagement of the adjusting plate (27) on the upper part (3). The adjusting plate (27) sits, because of the insertion connections (21,28,22,30 and 23,31) securely on the upper part, so that the spring clip (33) is engaged in its final position on the catch steps (35). The connection can easily be disconnected by finger pressure on the spring clip (34) in arrow direction (39).

FIG. 8 shows, finally, an exploded representation of the mounting plate's individual components, consisting of a baseplate (1), which is comprised of a bottom part (2) and an upper part (3), a locking screw (15) that secures the lateral position of the connection between the bottom part (2) and the upper part (3), as well as the adjusting plate (27) that inserts in the above described manner on the upper part (3) of the baseplate (1) and catches there.

DRAWING LEGEND

1 Baseplate
2 Bottom part
3 Upper part
4 Jog
5 Angle
6 Peg
7 Opening
8 Angle
9 Guiding groove
10 Guiding ridge
11 Guiding groove
12 Guiding ridge
13 Safety device against unintentional release
14 Surface
15 Locking screw
16 Borehole
17 Thread

18 Borehole
19 Borehole
20 Arrow direction
21 Indentation
22 Projection
23 Shank
24 Shoulder
25 Sliding surface
26 Sliding surface
27 Adjusting plate
28 Insertion projection
29 Stop
30 Shank
31 Shank
32 Nose
33 Spring clip
34 Lever
35 Catch step
36 Arrow direction
37 Arrow direction
38 Support
39 Arrow direction

What is claimed is:

1. Mounting plate for a cabinet hinge, the mounting plate comprising a baseplate adapted for attachment to a cabinet body, and an adjusting plate adapted for attachment to a cabinet hinge, the adjusting plate having a catch fastener and being connectable with the baseplate so that the catch fastener of the adjusting plate is firmly connected to the baseplate, wherein the baseplate comprises two parts, one of said parts being a bottom part adapted to be fastened to a cabinet body and the other of said parts being an upper part that is connected to the bottom part, wherein the adjusting plate is releaseably connectable to the upper part of the baseplate by at least three pairs of linkage points which allow a forced sliding motion between the adjusting plate and upper part, wherein the catch fastener of the adjusting plate further comprises a spring element which establishes a connection between the adjusting plate and the upper part of the baseplate at the at least three pairs of linkage points by the forced sliding motion upon an application of force on the adjusting plate which assures no further movement will take place between the adjusting plate and the upper part of the baseplate, and wherein the bottom part further comprises a safety device that takes the form of a tab on the bottom part, which fits on a corresponding surface of the upper part.

2. Mounting plate, according to claim 1, further comprising a jog on a front end and a peg on a back end of the bottom part, which contacts corresponding angles of the upper part.

3. Mounting plate, according to claim 1 wherein one of the bottom part and the upper part further comprises at least one guiding groove, which engages a corresponding at least one guiding ridge of the other of the upper part and the bottom part, when the bottom part and the upper part are set together.

4. Mounting plate, according to claim 1, wherein the connection between the bottom part and the upper part is secured by a releaseable locking screw.

5. Mounting plate, according to claim 4, wherein the releaseable locking screw serves simultaneously as a height adjustment screw.

6. Mounting plate, according to claim 1, wherein the upper part further comprises side indentations on a front end of the upper part, which engage in corresponding insertion projections of the adjusting plate.

7. Mounting plate, according to claim 1, wherein the upper part further comprises side projections that engage on corresponding insertion shanks of the adjusting plate.

8. Mounting plate, according to claim 1, wherein the upper part further comprises side insertion shanks on a back end of the upper part which engage corresponding insertion shanks of the adjusting plate.

9. Mounting plate, according to claim 1, wherein the adjusting plate further comprises side stops on a front upper end of the adjusting plate that engage shoulders formed on the upper part.

10. Mounting plate, according to claim 1, wherein the spring element is formed one-piece as a spring clip on the adjusting plate that projects at a back end of the adjustment plate and defines a resilient, frame-like border of the adjusting plate.

11. Mounting plate, according to claim 1, wherein the adjusting plate is connectable to the upper part of the base plate by engagement between insertion projections of the adjusting plate and indentations of the upper part of the baseplate, and by engagement between the projections of the upper part of the baseplate and insertion shanks of the adjusting plate by the forced sliding motion upon application of a rearward force on the adjustment plate, wherein the sliding motion is halted by a stop located on the adjusting plate engaging a shoulder of the upper part of the baseplate until a downward force is applied on a back end of the adjusting plate whereby the stop is no longer engaged with the shoulder, thereby allowing an engagement of the insertion shanks of the adjusting plate in the insertion shanks of the upper part of the baseplate, so that a spring clip of the spring element glides over a catch step on the upper part and urges engagement between the adjusting plate and the upper part.

12. Mounting plate, according to claim 11, wherein at least one of the insertion shanks of the adjusting plate is slideable on corresponding sliding surfaces of the upper part to produce the forced sliding motion between the adjusting plate and the upper part upon the application of the downward pressure.

13. Mounting plate, according to claim 1, wherein the spring element further comprises a spring clip for releasing the adjusting plate connection to the baseplate when the spring clip is lifted by finger pressure.

14. Mounting plate for a cabinet hinge, comprising a baseplate adapted for attachment to a cabinet body, and an adjusting plate adapted for attachment to a cabinet hinge, the adjusting plate having a catch fastener and being connectable with the baseplate with the catch fastener of the adjusting plate firmly connected to the baseplate, wherein the baseplate comprises a bottom part adapted to be fastened to a cabinet body and an upper part that is connected to the bottom part, wherein the adjusting plate is connectable to the upper part of the baseplate by at least three pairs of linkage points, and wherein the catch fastener of the adjusting plate has a spring element which urges a connection between the adjusting plate and the upper part of the baseplate at the three pairs of linkage points.

* * * * *